US012553623B2

(12) United States Patent
Yang et al.

(10) Patent No.: US 12,553,623 B2
(45) Date of Patent: Feb. 17, 2026

(54) HUMIDIFICATION AND PURIFICATION APPARATUS

(71) Applicant: GD MIDEA ENVIRONMENT APPLIANCES MFG CO., LTD., Zhongshan (CN)

(72) Inventors: Tao Yang, Zhongshan (CN); Zhenbin He, Zhongshan (CN); Runming Guo, Zhongshan (CN); Gaoyuan Liu, Zhongshan (CN); Hui Liu, Zhongshan (CN)

(73) Assignee: GD MIDEA ENVIRONMENT APPLIANCES MFG CO., LTD., Zhongshan (CN)

( * ) Notice: Subject to any disclaimer, the term of this patent is extended or adjusted under 35 U.S.C. 154(b) by 355 days.

(21) Appl. No.: 18/448,103

(22) Filed: Aug. 10, 2023

(65) Prior Publication Data

US 2024/0053033 A1 Feb. 15, 2024

(30) Foreign Application Priority Data

Aug. 15, 2022 (CN) ..... 202210975711.5

(51) Int. Cl.
*F24F 6/04* (2006.01)
*F24F 8/108* (2021.01)
(Continued)

(52) U.S. Cl.
CPC ..... *F24F 6/04* (2013.01); *F24F 8/108* (2021.01); *F24F 13/20* (2013.01); *F24F 13/24* (2013.01); *F24F 2006/008* (2013.01)

(58) Field of Classification Search
CPC .... F24F 6/04; F24F 8/108; F24F 13/20; F24F 13/24; F24F 2006/008; F24F 6/043;
(Continued)

(56) References Cited

U.S. PATENT DOCUMENTS 1,649,055 A * 11/1927 Blakeslee ..... F24F 6/043 261/104
2,387,473 A * 10/1945 Spitzka ..... F24F 5/0035 55/467
(Continued)

FOREIGN PATENT DOCUMENTS

CN 102844090 B 10/2014
CN 105091125 A * 11/2015 ..... F24F 13/062
(Continued)

OTHER PUBLICATIONS

Epo translation of KR20180063725 (Year: 2018).*
(Continued)

*Primary Examiner* — Stephen Hobson
(74) *Attorney, Agent, or Firm* — K&L Gates LLP

(57) ABSTRACT

The present application discloses a humidification and purification apparatus, which includes: a machine body provided with an air inlet and an air outlet; a purification and humidification module disposed in the machine body and close to the air inlet; and a blower disposed in the machine body and close to the air outlet. The purification and humidification module includes: a humidification module including a wet pad water tank, a wet pad and an elevation mechanism. The elevation mechanism is connected to the wet pad and is configured to drive the wet pad to move, and the humidification module can be switched between a humidifying state and a non-humidifying state. In the humidifying state, part of the wet pad is immersed into the water in the wet pad water tank, and in the non-humidifying state, the wet pad is lifted above the water level of the wet pad water tank.

19 Claims, 5 Drawing Sheets

(51) Int. Cl.
*F24F 13/20* (2006.01)
*F24F 13/24* (2006.01)
*F24F 6/00* (2006.01)

(58) Field of Classification Search
CPC ..... F24F 8/80; F24F 6/02; F24F 7/003; F24F 13/28; F24F 8/125; F24F 11/0008; F24F 11/72; F24F 2013/205; F24F 2140/00
See application file for complete search history.

(56) References Cited

U.S. PATENT DOCUMENTS 4,698,188 A * 10/1987 Gutmann ..... F24F 6/043 261/107
4,731,101 A * 3/1988 Kanda ..... B04C 5/10 55/472
5,641,343 A * 6/1997 Frey ..... B01D 46/521 55/330
5,800,741 A * 9/1998 Glenn ..... F24F 6/04 55/514
6,053,482 A * 4/2000 Glenn ..... F24F 6/043 261/DIG. 46
6,278,840 B1 * 8/2001 Basaganas Millan .. A61L 9/037 261/DIG. 65
6,523,810 B2 * 2/2003 Offir ..... F24F 6/043 261/DIG. 65
9,696,050 B2 * 7/2017 McGarva ..... F24F 11/0008
11,262,091 B2 * 3/2022 Kim ..... F24F 11/52
11,752,461 B2 * 9/2023 Jeon ..... F24F 13/28 55/482
12,044,429 B2 * 7/2024 Lee ..... B01D 46/4254
12,259,155 B2 * 3/2025 Tang ..... F24F 13/085
2001/0006260 A1 * 7/2001 Offir ..... F24F 11/39 261/107
2005/0067723 A1 * 3/2005 Parker ..... F24F 6/043 261/104
2006/0201119 A1 * 9/2006 Song ..... B01D 53/007 55/471
2011/0236229 A1 * 9/2011 Fitton ..... F04F 5/16 55/471
2012/0187586 A1 * 7/2012 Tsuda ..... F24F 6/06 476/72
2012/0267804 A1 * 10/2012 Rodrigs ..... F24F 6/04 261/107
2012/0319311 A1 * 12/2012 Nutter ..... A61L 9/20 250/437
2013/0313729 A1 * 11/2013 Sakai ..... F24F 6/025 261/130
2015/0204626 A1 * 7/2015 Martell ..... F28C 1/14 165/200
2015/0231542 A1 * 8/2015 Wennerstrom ..... F24F 13/28 55/356
2015/0338119 A1 * 11/2015 MCGarva ..... F24F 6/043 261/79.2
2016/0238037 A1 * 8/2016 Peet ..... F04D 25/08
2017/0122583 A1 * 5/2017 Lee ..... F24F 6/04
2017/0122596 A1 * 5/2017 Lee ..... F24F 11/30
2017/0130986 A1 * 5/2017 Wang ..... A61L 9/015
2017/0246581 A1 * 8/2017 Jung ..... F24F 8/10
2017/0248153 A1 * 8/2017 Park ..... F04D 29/703
2018/0001248 A1 * 1/2018 Jung ..... B01D 46/2411
2018/0252420 A1 * 9/2018 Kim ..... F24F 6/16
2019/0137124 A1 * 5/2019 Mcgarva ..... F24F 13/0272
2019/0264948 A1 * 8/2019 Jung ..... A61L 2/22
2020/0224892 A1 * 7/2020 Yang ..... F24F 1/029
2020/0298160 A1 * 9/2020 Jeon ..... B01D 46/58
2020/0298165 A1 * 9/2020 Kang ..... B01D 46/24
2021/0215382 A1 * 7/2021 Yoon ..... F26B 25/02
2021/0381518 A1 * 12/2021 Horton ..... F04D 25/10
2022/0032222 A1 * 2/2022 Park ..... F24F 13/082
2022/0154953 A1 * 5/2022 Herskovitz ..... F24F 13/081
2022/0178561 A1 * 6/2022 Oram ..... F24F 6/04
2022/0184540 A1 * 6/2022 Park ..... F24F 3/056
2022/0184542 A1 * 6/2022 Kim ..... F24F 8/108
2022/0184543 A1 * 6/2022 Choi ..... B01D 46/0049
2022/0218861 A1 * 7/2022 Chao ..... B01D 46/12
2022/0333796 A1 * 10/2022 Tang ..... F24F 3/16
2023/0115276 A1 * 4/2023 Chen ..... B01D 46/76 95/273
2023/0175721 A1 * 6/2023 Kim ..... F24F 13/28 55/471
2023/0221019 A1 * 7/2023 Wesley ..... F24F 8/10
2023/0280055 A1 * 9/2023 Gray ..... F24F 8/108 95/273
2024/0042384 A1 * 2/2024 Smith ..... B01D 46/10
2024/0053033 A1 * 2/2024 Yang ..... F24F 13/24
2024/0426489 A1 * 12/2024 Chen ..... F24F 13/20

FOREIGN PATENT DOCUMENTS

CN 105091305 A * 11/2015 ..... F24F 13/32
CN 105465893 A * 4/2016 ..... F24F 8/158
CN 107676908 A * 2/2018 ..... F24F 13/00
CN 108561974 A * 9/2018 ..... F24F 8/50
CN 108662704 A * 10/2018 ..... F24F 6/043
CN 110030644 A * 7/2019 ..... C01B 13/0262
CN 111089376 A * 5/2020 ..... F24F 8/108
CN 111089378 A * 5/2020 ..... F24F 8/10
CN 111457490 A * 7/2020 ..... F24F 8/20
CN 111735169 A * 10/2020 ..... B01D 29/35
CN 112944524 A * 6/2021 ..... F24F 6/08
CN 113465160 A * 10/2021 ..... F24F 13/28
CN 113483425 A * 10/2021 ..... F24F 6/06
CN 113531746 A * 10/2021 ..... F24F 8/108
CN 113587329 A * 11/2021 ..... F24F 8/80
CN 113739316 A * 12/2021 ..... F24F 13/28
CN 111156622 B * 4/2022 ..... F24F 11/52
CN 114484685 A * 5/2022 ..... F24F 8/22
CN 114526534 A * 5/2022 ..... F24F 8/133
CN 216744764 U * 6/2022 ..... F24F 8/22
CN 114777244 A * 7/2022 ..... F24F 13/00
CN 217022134 U * 7/2022
CN 115013930 A * 9/2022 ..... F24F 8/80
CN 115111687 A * 9/2022 ..... F24F 13/24
CN 115264702 A * 11/2022 ..... F24F 6/10
CN 115435488 A * 12/2022 ..... F24F 8/108
CN 115493233 A * 12/2022 ..... F24F 11/89
CN 115614875 A * 1/2023 ..... F24F 6/04
CN 115898914 A * 4/2023 ..... F24F 13/10
CN 116067001 A * 5/2023 ..... F24F 13/1426
CN 116105286 A * 5/2023 ..... F24F 8/108
CN 116147121 A * 5/2023 ..... F24F 8/80
CN 101755172 A * 6/2023 ..... F24F 6/06
CN 219141000 U * 6/2023 ..... A47L 11/282
CN 117073117 A * 11/2023 ..... F24F 8/108
CN 117387148 A * 1/2024 ..... F24F 11/89
CN 117628614 A * 3/2024 ..... F24F 8/00
CN 117989160 A * 5/2024 ..... F04D 29/703
CN 118729430 A * 10/2024 ..... F24F 11/64
CN 118935586 A * 11/2024 ..... F24F 13/10
CN 117804022 B * 12/2024 ..... F21V 33/0088
CN 119146457 A * 12/2024 ..... F24F 13/28
CN 119333917 A * 1/2025 ..... F24F 13/28
CN 119353748 A * 1/2025 ..... F24F 13/081
CN 111868453 B * 8/2025 ..... F24F 13/20
JP 2003302077 A * 10/2003
JP 2006071146 * 3/2006
JP 3776423 B2 * 5/2006
JP 4469689 B2 * 5/2010
JP 4595366 B2 * 12/2010
JP 2011179800 A * 9/2011
KR 20180063725 * 6/2010
KR 20120101788 A * 9/2012 ..... F24F 11/0001
KR 20160038203 * 4/2016
KR 20160038203 A * 4/2016 ..... F24F 13/28
KR 20180063725 A 6/2018
KR 102011030 B1 * 8/2019 ..... F24F 3/16
KR 102087679 B1 * 3/2020 ..... F24F 13/20
WO WO-2009070902 A1 * 6/2009 ..... F24F 6/043
WO WO-2019182375 A1 * 9/2019 ..... F24F 13/20

(56) References Cited

FOREIGN PATENT DOCUMENTS

| | | | | |
|---|---|---|---|---|
| WO | WO-2020141308 A1 * | 7/2020 | ..... | F24F 6/043 |
| WO | WO-2022061454 A1 * | 3/2022 | ..... | B01D 46/0015 |
| WO | WO-2024101546 A1 * | 5/2024 | ..... | F24F 13/082 |

OTHER PUBLICATIONS

Epo translation of KR20160038203 (Year: 2016).*
Epo translation of JP2006071146 (Year: 2006).*
Extended European Search Report received in EP Application No. 23189343.9; mailed Nov. 30, 2023.
First OA Received in KR Application No. 10-2023-0102834; mailed Dec. 18, 2024.

* cited by examiner

HUMIDIFICATION AND PURIFICATION APPARATUS

CROSS-REFERENCES TO RELATED APPLICATIONS

The present application claims priority to Chinese Patent Application No. 202210975711.5, both filed on Aug. 15, 2022, the entire contents of which are incorporated herein by reference.

FIELD

The present application relates to the field of electric appliance products, in particular to a humidification and purification apparatus.

BACKGROUND

With users' increasing demands for purifier-type products, the current purifiers solely for purification can no longer meet needs of users, so purifiers with humidification function have emerged. At present, a humidification and purification product usually uses a forward centrifugal blower system, which is disposed close to an air inlet.

The existing humidification and purification apparatus has low humidification capacity, low purification capacity and relatively large noise.

SUMMARY

A main purpose of embodiments of the present application is to provide a humidification and purification apparatus, which improves purification and humidification efficiencies, reduces operation noise and improves service performance of the humidification and purification apparatus.

In order to achieve the above purpose, the embodiments of the present application are as follows.

A humidification and purification apparatus is provided, which includes:

a machine body, provided with an air inlet and an air outlet;

a purification and humidification module, disposed in the machine body and close to the air inlet; and a blower, disposed in the machine body and close to the air outlet;

and the purification and humidification module includes:

a humidification module, including a wet pad water tank, a wet pad and an elevation mechanism, and the elevation mechanism is connected to the wet pad and is configured to be capable of driving the wet pad to move, and the humidification module can be switched between a humidifying state and a non-humidifying state, in the humidifying state, a portion of the wet pad is located below a water level of the wet pad water tank to be immersed into the water in the wet pad water tank, and in the non-humidifying state, the wet pad is lifted above the water level of the wet pad water tank; and a purification module, having an annular shape and at least partially sleeved outside a portion of the wet pad extending out of the wet pad water tank.

In some exemplary embodiments, the elevation mechanism includes:

a driving component; and a transmission assembly, connected to the driving component and the wet pad and configured to be capable of converting a rotational movement output by the driving component into a linear movement of the wet pad.

In some exemplary embodiments, the transmission assembly includes:

a turntable, connected to the driving component, and an outer wall surface of the turntable is provided with an external thread; and an elevation bracket, provided with an internal thread matched with the external thread, and a guide structure for translating the elevation bracket along an axial direction of the turntable is disposed between the elevation bracket and the wet pad water tank, and the wet pad is mounted to the elevation bracket.

In some exemplary embodiments, the wet pad water tank is provided with a mounting cavity and a reservoir cavity surrounding the mounting cavity, the driving component is mounted in the mounting cavity, the turntable is positioned outside the mounting cavity and rotatably mounted to a cavity wall of the mounting cavity, and a drive shaft of the driving component passes through the cavity wall of the mounting cavity and is connected to the turntable; and the elevation bracket has an annular shape and is sleeved outside the mounting cavity, and the internal thread is disposed on an inner wall surface of the elevation bracket.

In some exemplary embodiments, the wet pad has an annular shape and is sleeved outside the elevation bracket; and an outer wall surface of the elevation bracket is provided with a step surface supporting the wet pad.

In some exemplary embodiments, a movement direction of the wet pad is configured to be parallel to an axial direction of the purification module, and a sleeved area of the wet pad and the purification module is configured to be increased as the wet pad is lifted and to be decreased as the wet pad is lowered.

In some exemplary embodiments, the purification and humidification module further includes: a water level detection device configured to detect an actual water level of the wet pad water tank;

the humidification and purification apparatus further includes a control device electrically connected to the water level detection device and the elevation mechanism, the control device is configured to control operation of the elevation mechanism according to a detection result of the water level detection device, and a portion of the wet pad is moved below the actual water level of the wet pad water tank, or the wet pad is lifted above the actual water level of the wet pad water tank.

In some exemplary embodiments, the humidification and purification apparatus further includes:

a control device, electrically connected to the elevation mechanism, and configured to control operation of the elevation mechanism, and a portion of the wet pad is moved below a rated water level of the wet pad water tank, or the wet pad is lifted above the rated water level of the wet pad water tank.

In some exemplary embodiments, the control device is electrically connected to the blower and is configured to control the operation of the blower to air-dry the wet pad after the wet pad is lifted above the water level of the wet pad water tank.

In some exemplary embodiments, the purification and humidification module further includes:

a limit ring, nested between the wet pad and the purification module, and supported on the wet pad water tank, and the limit ring is provided with a ventilation hole.

In some exemplary embodiments, an end of the purification module close to the blower protrudes from an end of the wet pad close to the blower when the humidification module is in the humidification state.

In some exemplary embodiments, the humidification and purification apparatus further includes:

an air duct assembly, disposed in the machine body and communicated with the air inlet and the air outlet, and the blower is disposed in the air duct assembly, the purification and humidification module is disposed between an air inlet side of the air duct assembly and the air inlet, and the purification and humidification module and the air duct assembly are disposed along an axial direction of the purification module; and and the blower is configured to drive air to enter from the air inlet, flow through the purification and humidification module along a radial direction of the purification module, then flow through the air duct assembly along the axial direction of the purification module and reach the air outlet for outflow.

In some exemplary embodiments, when the humidification module is in the humidifying state, a height by which an end of the purification module close to the blower protrudes from an end of the wet pad close to the blower is H, and an air guide ring is provided at the air inlet side of the air duct assembly, a minimum inner diameter of the air guide ring is D, and $0.1 \leq H/D \leq 0.4$.

The humidification and purification apparatus according to an embodiment of the present application uses a blower as a power system to drive indoor air to enter the machine body of the humidification and purification apparatus from the air inlet for purification and humidification, to ensure the quality of indoor air. Compared with a forward centrifugal blower system, the blower used by the present humidification and purification apparatus is disposed close to the air outlet of the machine body, which is a backward centrifugal blower. During operation of the blower, it can suck gas, and the machine body is in a negative pressure state. An air volume sucked by the blower is larger than a draught volume of the forward centrifugal blower system, which is conducive to improving the purification and humidification efficiency of the humidification and purification apparatus. In one embodiment, noise of this blower is low during operation, which is conducive to reducing noise of the humidification and purification apparatus and improves use performance of the humidification and purification apparatus.

The elevation mechanism can drive the wet pad to perform elevation movement, and a portion of the wet pad is immersed into water in the wet pad water tank, and the wet pad absorbs the water in the wet pad water tank and humidifies the passing air. The elevation mechanism can also drive the wet pad to move, and the whole wet pad can be lifted above the water level of the wet pad water tank, thus avoiding problems of growth of bacteria and viruses caused by long-term immersion of the wet pad in water.

BRIEF DESCRIPTION OF THE DRAWINGS

In order to explain the embodiments of the present application more clearly, drawings required to be used in the description of the embodiments or the prior art will be briefly described below. It is apparent that the drawings described below are merely some embodiments of the present application.

REFERENCE NUMBERS

Figure 1:
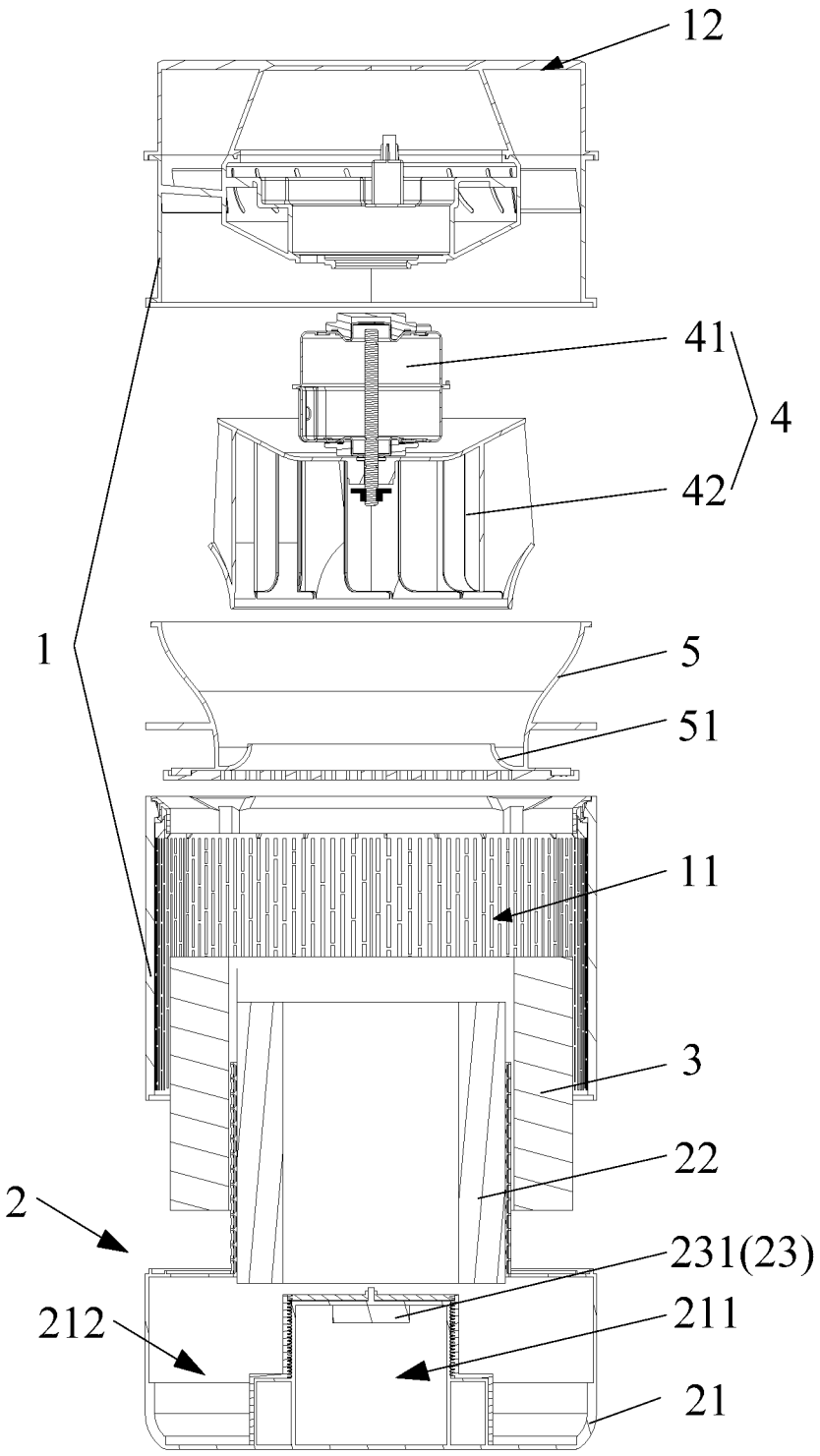
FIG. 1 is a schematic diagram of an exploded structure of a humidification and purification apparatus according to an embodiment of the present application.

1—machine body, 11—air inlet, 12—air outlet, 2—humidification module, 21—wet pad water tank, 211—mounting cavity, 212—reservoir cavity, 22—wet pad, 23—elevation mechanism, 231—driving component, 232—turntable, 2321—external thread, 233—elevation bracket, 2331—internal thread, 2332—step surface, 24—water level detection device, 25—limit ring, 251—ventilation hole, 3—purification module, 4—blower, 41—motor, 42—centrifugal wind wheel, 5—air duct assembly, 51—air guide ring.

Realization of the embodiments of the present application will be further explained with reference to the accompanying drawings in connection with the embodiments.

DETAILED DESCRIPTION OF THE DISCLOSURE

A clear and complete description of the embodiments of the present application will be given below with reference to the accompanying drawings in the embodiments of the present application, and it will be apparent that the described embodiments are only part of the embodiments of the present application, not all of them.

As shown in FIGS. 1-5, an embodiment of the present application provides a humidification and purification apparatus, which includes a machine body 1, a purification and humidification module and a blower 4 which are disposed in the machine body 1.

The machine body 1 is provided with an air inlet 11 and an air outlet 12, and the air inlet 11 and the air outlet 12 can be communicated with each other. The air inlet 11 may be disposed on a side wall of the machine body 1, and the air outlet 12 may be disposed on a top wall of the machine body 1.

The purification and humidification module is disposed close to the air inlet 11, and the blower 4 is disposed close to the air outlet 12.

The purification and humidification module includes a humidification module 2 and a purification module 3.

Figure 2:
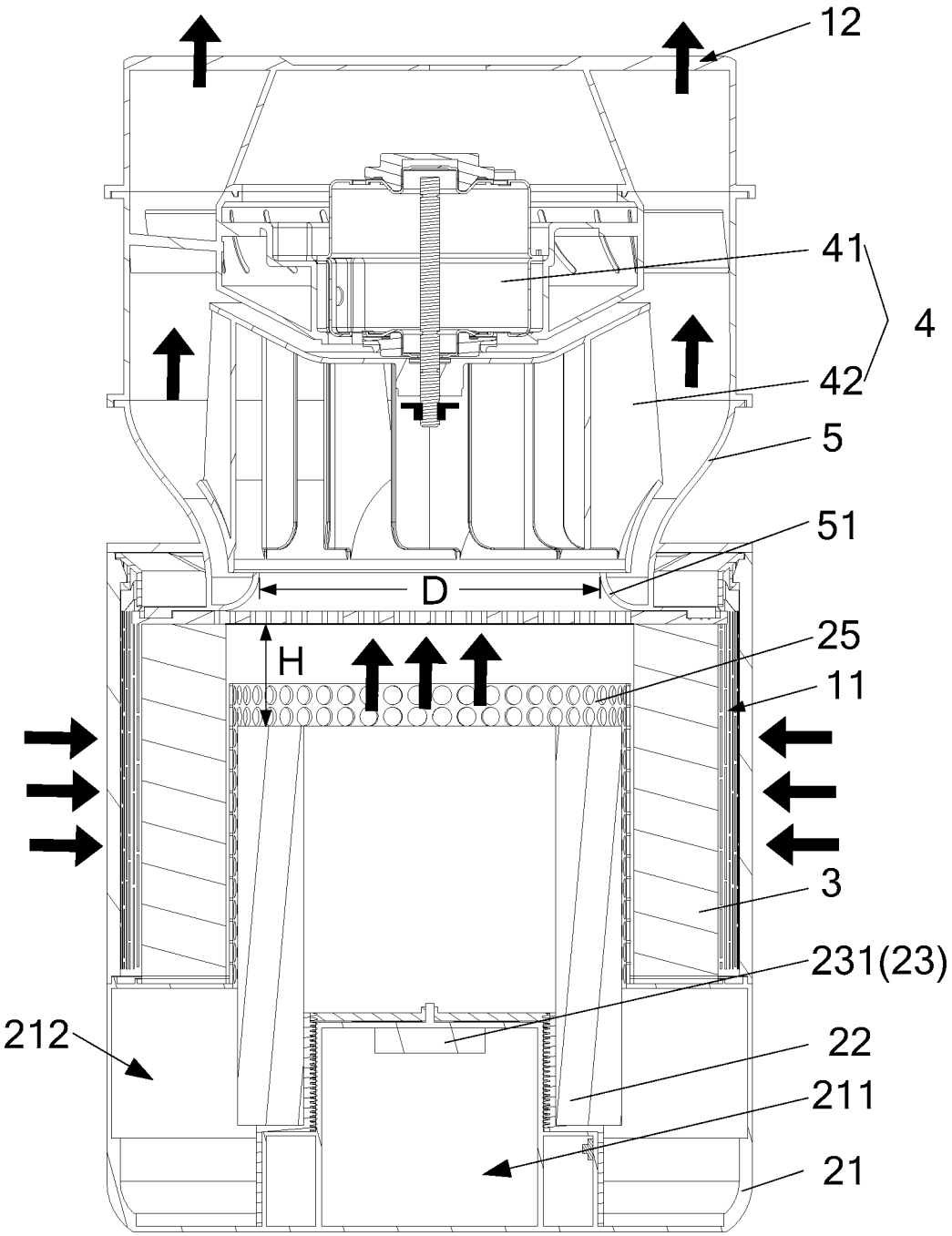
FIG. 2 is a schematic diagram of a cross-sectional structure of the humidification and purification apparatus shown in FIG. 1, and the humidification and purification apparatus is in a normal operating state (a humidification module is in a humidifying state).
Figure 3:
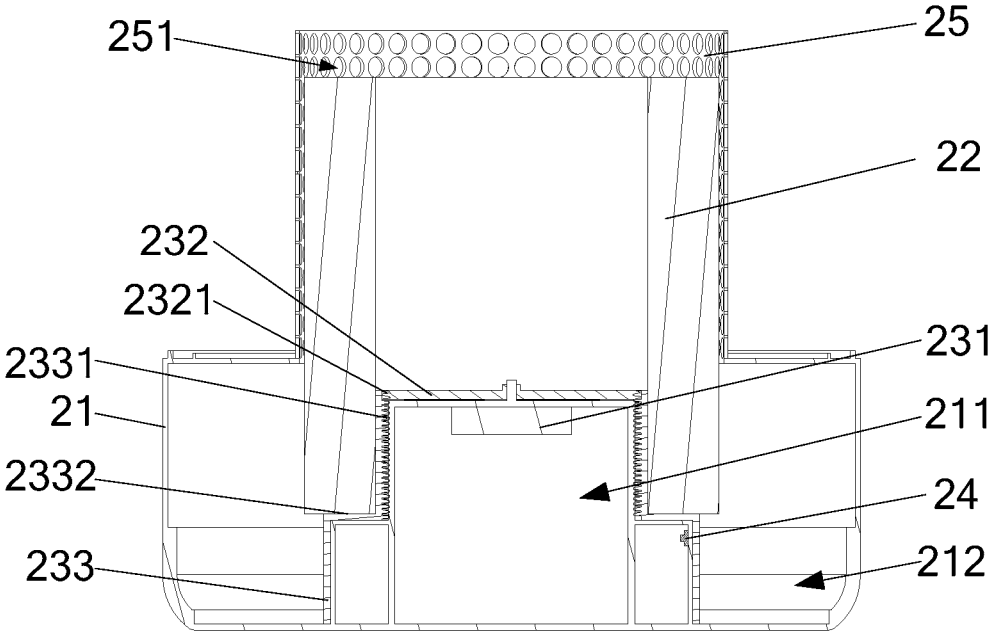
FIG. 3 is a schematic diagram of a structure of the humidification module of the humidification and purification apparatus shown in FIG. 2.
Figure 4:
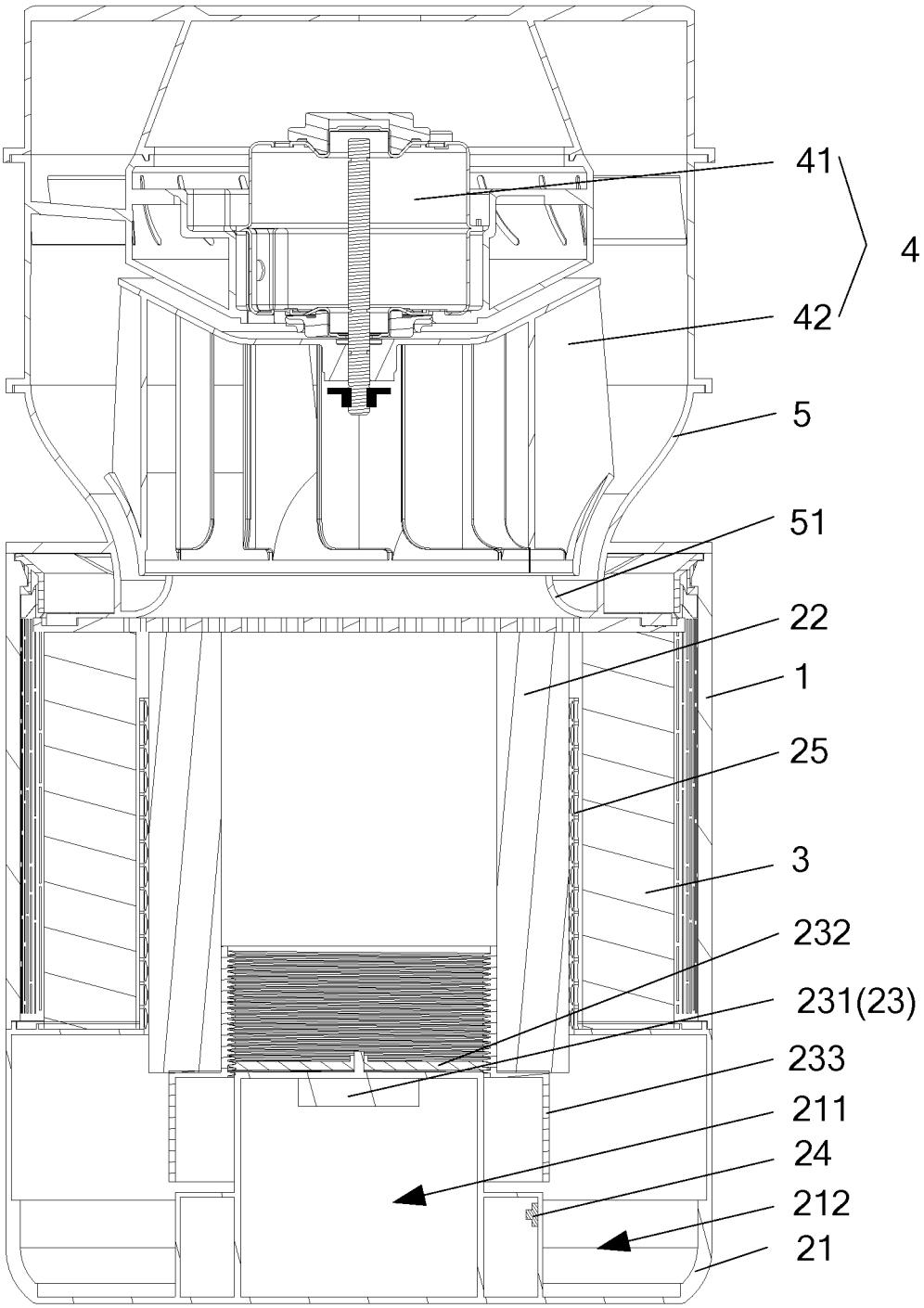
FIG. 4 is a schematic diagram of a cross-sectional structure of the humidification and purification apparatus shown in FIG. 1, and the humidification and purification apparatus is in a non-operating state (the humidification module is in a non-humidifying state).
Figure 5:
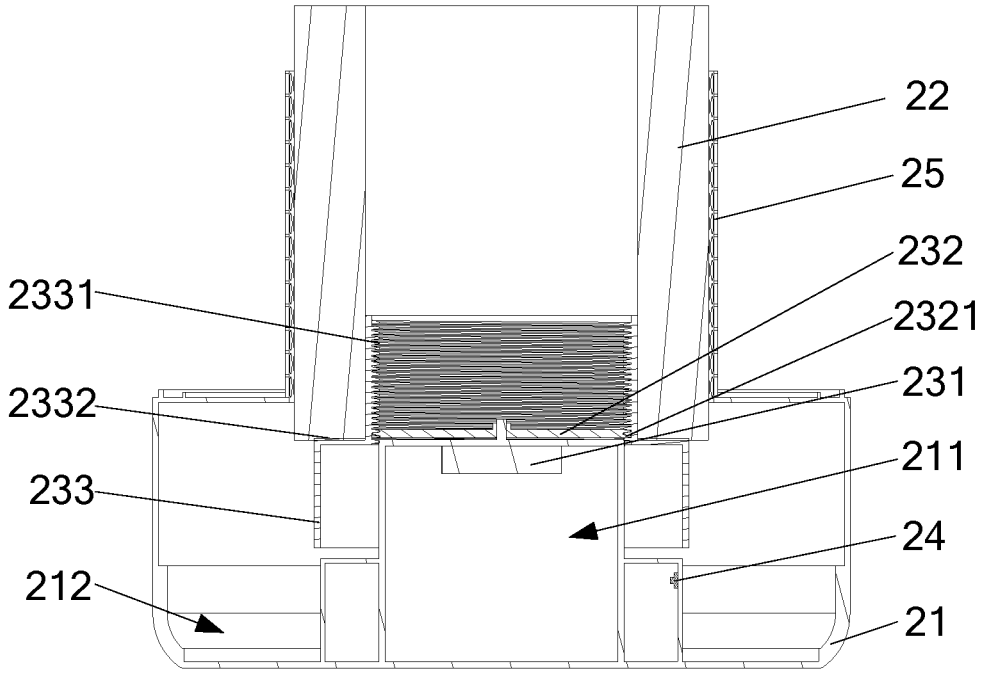
FIG. 5 is a schematic diagram of a structure of the humidification module of the humidification and purification apparatus shown in FIG. 4.

The humidification module 2 includes a wet pad water tank 21, a wet pad 22 and an elevation mechanism 23. The elevation mechanism 23 is connected to the wet pad 22 and is configured to be capable of driving the wet pad 22 to move, and the humidification module 2 can be switched between a humidifying state and a non-humidifying state. In the humidifying state, a portion of the wet pad 22 is located below a water level of the wet pad water tank 21 to be immersed into water in the wet pad water tank 21 (as shown in FIGS. 2 and 3). In the non-humidifying state, the wet pad 22 is lifted above the water level of the wet pad water tank 21 (as shown in FIGS. 4 and 5).

The purification module 3 has an annular shape and is at least partially sleeved outside a portion of the wet pad 22 extending out of the wet pad water tank 21.

The humidification and purification apparatus according to the embodiment of the present application uses the blower 4 as a power system to drive indoor air into the machine body 1 of the humidification and purification apparatus from the air inlet 11, and the purification and humidification module in the machine body 1 purifies and humidifies the air, and the wet air that has been purified and humidified is discharged out of the machine body 1 from the air outlet 12 and returns to the room (a flow direction of the air is shown by arrows in FIG. 2). The indoor air is purified and humidified by the humidification and purification apparatus, and quality of the indoor air is also ensured. Besides, compared with a forward centrifugal blower system, the blower 4 of the humidification and purification apparatus is disposed close to the air outlet 12 of the machine body 1, which is a backward centrifugal blower. During operation of the blower 4, it can suck gas, and the machine body 1 is in a negative pressure state. An air volume sucked by the blower 4 is larger than a draught volume of the forward centrifugal blower system, which is conducive to improving purification and humidification efficiencies of the humidification and purification apparatus. In one embodiment, noise of the blower 4 is low during operation, which is conducive to reducing the noise of the humidification and purification apparatus in operation and improving use performance of the humidification and purification apparatus.

The wet pad water tank 21 may be used for storing water, and an opening may be provided at an upper end of the wet pad water tank 21 and the wet pad 22 extends into the wet pad water tank 21 from the opening. The elevation mechanism 23 is connected to the wet pad 22, and the elevation mechanism 23 can drive the wet pad 22 to perform elevation movement, and a portion (lower portion) of the wet pad 22 is immersed into the water in the wet pad water tank 21, the wet pad 22 absorbs the water in the wet pad water tank 21, and the wetted pad 22 is used to humidify the passing air to achieve the humidification function. At this time, the humidification module 2 may be in a humidifying state as shown in FIGS. 2 and 3. The elevation mechanism 23 can also drive the wet pad 22 to move, and the whole wet pad 22 can be lifted above the water level (actual water level or rated water level) of the wet pad water tank 21, to avoid problems such as growth of bacteria and viruses caused by long-term immersion of the wet pad 22 in water. At this time, the humidification module 2 may be in a non-humidifying state as shown in FIGS. 4 and 5.

The purification module 3 is provided in an annular shape. The purification module 3 may be disposed outside the wet pad water tank 21 and is at least partially sleeved outside a portion of the wet pad 22 extending out of the wet pad water tank 21. As shown in FIGS. 1-2 and 4, the wet pad 22 has an annular shape, and the purification module 3 includes an annular filter element which may be sleeved outside the wet pad 22 from top to bottom. A lower end of the filter element may abut against an upper end face of the wet pad water tank 21 to support the filter element. An inner diameter of the filter element may be greater than an outer diameter of the wet pad 22, and there is a gap between the filter element and the wet pad 22.

The filter element and the wet pad 22, which are nested, are disposed between the air inlet 11 and the blower 4. When the humidification and purification apparatus is operating normally, the blower 4 is started, and external dry air enters through the air inlet 11. Before entering the blower 4, the dry air will be purified by the annular purification module 3, then further wetted by the annular wet pad 22, and accelerated by the blower 4 and then discharged through the air outlet 12.

Compared with the stacking of the filter element and the wet pad, the nested arrangement of the filter element and the wet pad 22 in the embodiment of the present application is conducive to reducing an overall axial height of the purification and humidification module, to greatly save space, simultaneously reducing wind resistance of the whole machine, improving the purification and humidification efficiencies of the humidification and purification apparatus and reducing the operation noise.

In some exemplary embodiments, a movement direction of the wet pad 22 is configured to be parallel to an axial direction of the purification module 3, and a height of the wet pad 22 extending into the purification module 3 is configured to be increased as the wet pad 22 is lifted and be decreased as the wet pad 22 is lowered.

The elevation mechanism 23 drives the wet pad 22 to perform elevation movement. When the wet pad 22 is lifted, the height of the wet pad 22 extending into the purification module 3 is increased. On the contrary, when the wet pad 22 is lowered, the height of the wet pad 22 extending into the purification module 3 is decreased. Therefore, when the wet pad 22 is lowered to be partially immersed into the water in the wet pad water tank 21 (the humidification module 2 is in the humidifying state), the height of the wet pad extending into the purification module 3 (as shown in FIG. 2) is configured to be smaller than the height of the wet pad extending into the purification module 3 (as shown in FIG. 4) when the wet pad 22 is lifted above the water level of the wet pad water tank 21 (the humidification module 2 is in the non-humidifying state), that is, the height of the wet pad extending into the purification module 3 is relatively small when the humidification module 2 is in the humidifying state. Thus, when the blower 4 is operating, indoor air may enter through the air inlet 11 and flow through the purification module 3 for purification. For the air flowing into the purification module 3, a part of the air may flow through the wet pad 22 for humidification, and the other part of the air may not be humidified by the wet pad 22, which is conducive to balancing the wind resistance and humidification effect of the whole machine.

In some exemplary embodiments, as shown in FIGS. 1-5, the elevation mechanism 23 includes a driving component 231 and a transmission assembly.

The transmission assembly is configured to be connected to the driving component 231 and the wet pad 22 and is configured to be capable of converting a rotational movement output by the driving component 231 into a linear movement of the wet pad 22.

The driving component 231 may include an elevation motor to electrically control the elevation movement of the elevation mechanism 23. In one embodiment, the driving component 231 may also be a manual driving component to manually control the elevation operation of the elevation mechanism 23.

The transmission assembly includes a turntable 232 and an elevation bracket 233. The driving component 231 is connected to the turntable 232 and configured to be capable of driving the turntable 232 to rotate. An outer wall surface of the turntable 232 is provided with an external thread 2321, the elevation bracket 233 is provided with an internal thread 2331 matched with the external thread 2321, and a guide structure for translating the elevation bracket 233 along an axial direction of the turntable 232 is disposed between the elevation bracket 233 and the wet pad water tank 21, and the wet pad 22 is mounted to the elevation bracket 233.

In the transmission assembly, the turntable 232 is connected to the driving component 231, and a rotation axis of the turntable 232 extends along a vertical direction (up-down direction). The elevation bracket 233 may have an annular shape and be sleeved outside the turntable 232. The outer wall surface of the turntable 232 is provided with the external thread 2321. An inner wall surface of the elevation bracket 233 is provided with an internal thread 2331. The internal thread 2331 and the external thread 2321 may be meshed for transmission. A guide structure (not shown) is provided between the elevation bracket 233 and the wet pad water tank 21 to translate the elevation bracket 233 along the axial direction of the turntable 232 (that is, to perform the elevation movement). The guide structure may include a guide protrusion provided on one of the elevation bracket 233 and the wet pad water tank 21, and a guide groove provided on the other of the elevation bracket 233 and the wet pad water tank 21. The guide protrusion and the guide groove extend along the axial direction (up-down direction) of the turntable 232, and the guide protrusion may be slidably inserted into the guide groove, and the elevation bracket 233 can translate along the axial direction of the turntable 232 under cooperation between the guide protrusion and the guide groove.

When the elevation mechanism 23 is operating, the driving component 231 drives the turntable 232 to rotate in forward and reverse directions. Through the cooperation between the external thread 2321 of the turntable 232 and the internal thread 2331 of the elevation bracket 233 and the action of the guide structure between the elevation bracket 233 and the wet pad water tank 21, the rotation movement of the turntable 232 can be converted into a linear movement of the elevation bracket 233, and the elevation bracket 233 can perform an elevation movement (up and down movement). When the driving component 231 drives the turntable 232 to rotate in a forward direction (or in a reverse direction), the elevation bracket 233 can drive the wet pad 22 mounted thereon to be lowered until a portion (lower portion) of the wet pad 22 is immersed into the water in the wet pad water tank 21, and the wet pad 22 absorbs the water in the wet pad water tank 21, and humidifies the passing air by the wetted pad 22. When the driving component 231 drives the turntable 232 to rotate in the reverse direction (or in the forward direction), the elevation mechanism 23 can drive the wet pad 22 to be lifted, and the whole wet pad 22 is lifted above the water level of the wet pad water tank 21, thus avoiding problems such as growth of bacteria and viruses caused by long-term immersion of the wet pad 22 in water.

It should be understood that the transmission assembly can realize the conversion of the rotational movement output by the driving component into the linear movement of the wet pad not only by the cooperation between the internal thread and the external thread, such conversion can also be realized by other structures, such as a rack-and-gear structure, etc. For example, the transmission assembly may include a gear and an elevation bracket provided with a rack, the gear is connected to the driving component, and the gear and the rack are meshed for transmission, and the driving component may drive the gear to rotate in a forward or reverse direction, and then drive the elevation bracket and the wet pad mounted thereon to perform elevation movement through the meshing of the gear and the rack.

In some exemplary embodiments, as shown in FIGS. 1-5, the wet pad water tank 21 is provided with a mounting cavity 211 and a reservoir cavity 212 surrounding the mounting cavity 211. The driving component 231 is mounted in the mounting cavity 211, and the turntable 232 is positioned outside the mounting cavity 211 and rotatably mounted to a cavity wall of the mounting cavity 211. A drive shaft of the driving component 231 passes through the cavity wall of the mounting cavity 211 and is connected to the turntable 232, and the elevation bracket 233 is sleeved outside the mounting cavity 211.

The wet pad water tank 21 is provided with a mounting cavity 211 and a reservoir cavity 212. The mounting cavity 211 may be a cylindrical cavity and the reservoir cavity 212 may be annular and disposed surrounding the mounting cavity 211. The mounting cavity 211 may be used for mounting the driving component 231, and the driving component 231 is mounted in the mounting cavity 211, and the normal operation of the driving component 231 can be prevented from being affected by water. As shown in FIGS. 2-5, the driving component 231 may be mounted on a cavity wall of the mounting cavity 211 away from a bottom wall of the wet pad water tank 21, that is, the driving component 231 may be mounted on a top wall of the mounting cavity 211.

The turntable 232 is located outside the mounting cavity 211 and is rotatably mounted on the cavity wall of the mounting cavity 211 to realize rotatability of the turntable 232. As shown in FIGS. 2-5, the turntable 232 may be mounted on the cavity wall of the mounting cavity 211 away from the bottom wall of the wet pad water tank 21, that is, the turntable 232 may be mounted on the top wall of the mounting cavity 211, and a drive shaft of the driving component 231 may pass through the top wall of the mounting cavity 211 to achieve connection between the driving component 231 and the turntable 232. In one embodiment, the turntable 232 may also be mounted on other parts except the top wall of the mounting cavity 211, for example, the turntable 232 may also be mounted on the bottom wall of the mounting cavity 211.

The elevation bracket 233 is sleeved outside the mounting cavity 211, and the elevation bracket 233 is sleeved outside the turntable 232 mounted to the cavity wall of the mounting cavity 211, and transmission cooperation between the internal thread 2331 on the elevation bracket 233 and the external thread 2321 on the turntable 232 is implemented. A center axis of the elevation bracket 233, a rotation axis of the drive shaft of the driving component 231 and a rotation axis of the turntable 232 may be collinear with each other. The elevation bracket 233 is sleeved outside the mounting cavity 211, which facilitates the elevation bracket 233 to drive the lower portion of the wet pad 22 to be immersed into the water in the reservoir cavity 212 to humidify the air.

The guide structure between the elevation bracket 233 and the wet pad water tank 21 includes a guide protrusion and a guide groove extending in the axial direction (up and down direction) of the turntable 232. The guide protrusion may be provided on one of the elevation bracket 233 and the wet pad water tank 21, and the guide groove may be provided on the other of the elevation bracket 233 and the wet pad water tank 21. For example, the guide protrusion may be provided on the inner wall surface of the elevation bracket 233, and the guide groove may be provided on the outer wall surface of the mounting cavity 211.

In some exemplary embodiments, as shown in FIGS. 3 and 5, the outer wall surface of the elevation bracket 233 is provided with a step surface 2332, and the wet pad 22 is sleeved outside the elevation bracket 233 and supported on the step surface 2332.

The outer wall surface of the elevation bracket 233 is provided with a step surface 2332, the step surface 2332 may be annular and is used for supporting the wet pad 22, and the annular wet pad 22 can be sleeved outside the elevation bracket 233 and supported on the step surface 2332 of the elevation bracket 233, thus the wet pad 22 is supported and fixed.

In some exemplary embodiments, as shown in FIGS. 2-5, the purification and humidification module further includes a water level detection device 24. The water level detection device 24 is configured to detect an actual water level of the wet pad water tank 21.

The humidification and purification apparatus further includes a control device configured to be electrically connected to the water level detection device 24 and the elevation mechanism 23, and the control device is configured to control operation of the elevation mechanism 23 according to a detection result of the water level detection device 24, and a portion (lower portion) of the wet pad 22 is moved below the actual water level of the wet pad water tank 21, or the wet pad 22 is lifted above the actual water level of the wet pad water tank 21.

The water level detection device 24 may be mounted in the wet pad water tank 21 and detects the actual water level of the wet pad water tank 21. When the humidification and purification apparatus is operating, the control device may control the elevation movement of the elevation mechanism 23 according to the actual water level detected by the water level detection device 24, and the lower portion of the wet pad 22 can be moved below the actual water level of the wet pad water tank 21, and the lower portion of the wet pad 22 can be immersed in water, thus the wet pad 22 can humidify the air after absorption. When the humidification and purification apparatus is in a non-operating state (i.e., the humidification module 2 is not humidifying), the control device may control the elevation movement of the elevation mechanism 23 according to the actual water level detected by the water level detection device 24, and the lower part of the wet pad 22 can be moved up above the actual water level of the wet pad water tank 21, and the whole wet pad 22 is not immersed in water, thus avoiding the problems such as growth of bacteria and viruses caused by long-term immersion of the wet pad 22 in water.

In one embodiment, the purification and humidification module may not include the water level detection device 24, but may control the elevation movement of the elevation mechanism 23 according to the rated water level defined in the wet pad water tank 21.

For example, in some other exemplary embodiments, the humidification and purification apparatus further includes a control device electrically connected to the elevation mechanism 23, and the control device is configured to control the operation of the elevation mechanism 23 to move a portion of the wet pad 22 below the rated water level of the wet pad water tank 21, or to lift the wet pad 22 above the rated water level of the wet pad water tank 21.

The wet pad water tank 21 has a rated water level, and the actual water level in the wet pad water tank 21 is not higher than the rated water level. At the beginning, the actual water level in the wet pad water tank 21 is at the rated water level, and the actual water level in the wet pad water tank 21 gradually decreases as the humidification module 2 is performing humidification.

The elevation mechanism 23 may drive the wet pad 22 to move downward, and the lower portion of the wet pad 22 moves to a position with a predefined distance below the rated water level of the wet pad water tank 21 (for example, the wet pad 22 is lowered to abut against a bottom surface of the reservoir cavity 212 of the wet pad water tank 21), to ensure that the lower portion of the wet pad 22 is immersed in water and is able to perform absorption and humidification. Or, the elevation mechanism 23 may also drive the wet pad 22 to move upward, and the whole wet pad 22 can be lifted above the rated water level of the wet pad water tank 21, to avoid the wet pad 22 from being immersed in water for a long time when the humidification and purification apparatus is not operating.

In some exemplary embodiments, the control device is also electrically connected to the blower 4 and is configured to control the operation of the blower 4 to air-dry the wet pad 22 after the wet pad 22 is lifted above the water level of the wet pad water tank 21.

The control device may also be electrically connected to the centrifugal blower system. When the humidification and purification apparatus is operating normally, the control device may control the operation of the blower and indoor air is driven to enter the machine body of the humidification and purification apparatus from the air inlet. The purification module 3 and the humidification module 2 in the machine body purify and humidify the air, and the wet air that has been purified and humidified is discharged out of the machine body from the air outlet and returns to the room. When the humidification and purification apparatus does not need to perform humidification, the control device may first control the elevation mechanism 23 to actuate to lift the wet pad 22 above the water level of the wet pad water tank 21, and then control the blower to drive indoor air into the machine body of the humidification and purification apparatus from the air inlet, and the wet pad 22 is air-dried by air flow.

The power of the blower when air-drying the wet pad 22 may be P1, and the power of the blower when purifying and humidifying the air may be P2, and P1 may be less than P2, to reduce the noise when air-drying the wet pad 22. In one embodiment, P1 may also be configured to be equal to or greater than P2 to accelerate the air-drying of the wet pad 22.

In some exemplary embodiments, as shown in FIGS. 2-5, the purification and humidification module further includes a limit ring 25. The limit ring 25 is nested between the wet pad 22 and the purification module 3 and is supported on the wet pad water tank 21, and the limit ring 25 is provided with a ventilation hole 251.

Since a material of the wet pad 22 is soft and easy to deform, the limit ring 25 is disposed between the annular wet pad 22 and the purification module 3, that is, the purification module 3, the limit ring 25 and the wet pad 22 are sequentially sleeved from outside to inside, and the limit ring 25 and the purification module 3 are supported on an upper end face of the wet pad water tank 21. Compared with a gap between the wet pad 22 and the purification module 3, a gap between the limit ring 25 and the wet pad 22 is smaller, which is conducive to ensuring the concentricity of the wet pad 22 and the purification module 3, and can reduce a deformation degree of the wet pad 22 to ensure a humidification effect of the wet pad 22. The limit ring 25 is provided with the ventilation hole 251, and the air purified by the purification module 3 flows to the wet pad 22 after passing through the ventilation hole 251 of the limit ring 25, and the wet pad 22 humidifies the air.

A structural strength of the limit ring 25 may be greater than that of the wet pad 22, and the limit ring 25 is not easily deformed. For example, the limit ring 25 may be made of plastic or other materials.

In some exemplary embodiments, as shown in FIGS. 1, 2, and 4, the blower 4 includes a centrifugal wind wheel 42 and a motor 41. The centrifugal wind wheel 42 is located at a side of the motor 41 close to the purification module 3 and connected to a motor shaft of the motor 41. The motor 41 may drive the centrifugal wind wheel 42 to rotate, and external dry air enters through the air inlet 11 and is purified by the purification module 3 and humidified by the humidification module 2, and then the air is discharged from the air outlet 12.

In some exemplary embodiments, axes of the motor 41, the centrifugal wind wheel 42, the wet pad 22, and the purification module 3 are collinear.

The motor 41 and the centrifugal wind wheel 42 serve as a power system of the whole machine, and in the whole machine, the axes of the motor 41, the centrifugal wind wheel 42, the wet pad 22 and the purification module 3 are collinear, and the axes may extend along the vertical direction. The axes of the motor 41, the centrifugal wind wheel 42, the wet pad 22 and the purification module 3 are collinear, which is conducive to reducing the wind resistance of the whole machine and improving the purification and humidification efficiencies.

In some exemplary embodiments, as shown in FIG. 2, when the humidification module 2 is in the humidifying state, an end of the purification module 3 close to the blower 4 protrudes from an end of the wet pad 22 close to the blower 4.

As shown in FIG. 2, when the humidification module 2 is in the humidifying state, the end of the purification module 3 close to the blower 4 (i.e. the upper end of the purification module 3) protrudes from the end of the wet pad 22 close to the blower 4 (i.e. the upper end of the wet pad 22), and after the air enters the machine body 1 and is purified by the purification module 3, part of the air may pass through the lower wet pad 22 and be wetted by the wet pad 22, part of the air passes above the wet pad 22, i.e., is not wetted by the wet pad 22, and the wetted air and the non-wetted air are finally discharged from the air outlet 12.

Compared with a scheme in which the upper end of the purification module 3 is flush with the upper end of the wet pad 22 and all the purified air is wetted through the wet pad 22, the upper end of the purification module 3 protrudes from the upper end of the wet pad 22, and part of the air may not be wetted through the wet pad 22, which is conducive to reducing wind resistance, improving ventilation quantity of the humidification and purification apparatus, and balancing both the humidifying effect and the operation efficiency of the whole machine.

In some exemplary embodiments, as shown in FIGS. 1, 2, and 4, the humidification and purification apparatus is configured to further include an air duct assembly 5. The air duct assembly 5 is disposed in the machine body 1 and communicated with the air inlet 11 and the air outlet 12, and an air guide ring 51 is provided at an air inlet side of the air duct assembly 5. The blower 4 is at least partially disposed in the air duct assembly 5.

As shown in FIG. 1, FIG. 2 and FIG. 4, the air duct assembly 5 may be a split assembly structure or an integrated structure. An inner wall surface of the air guide ring 51 disposed at the air inlet side of the air duct assembly 5 may be a cambered surface, to guide the air flow entering the air duct assembly 5, reduce generation of turbulence, which is conducive to reducing the wind resistance and improving an air intake efficiency.

In some exemplary embodiments, as shown in FIGS. 1, 2 and 4, the purification and humidification module is located outside the air duct assembly 5 and between the air inlet side of the air duct assembly 5 and the air inlet 11. The purification and humidification module and the air duct assembly 5 are disposed along the axial direction of the purification module 3, and the inner cavity of the annular purification module 3 is communicated with the air guide ring 51 at the air inlet side of the air duct assembly 5.

An end (lower end) of the purification module 3 away from the air duct assembly 5 may be abutted against the upper end face of the wet pad water tank 21, and an end (upper end) of the purification module 3 close to the air duct assembly 5 may be abutted against the air inlet side of the air duct assembly 5, and the inner cavity of the purification module 3 is communicated with the air guide ring 51. In this way, during operation of the blower 4, the indoor air may enter from the air inlet 11, flow through the purification and humidification module along the radial direction of the purification module 3, and then flow through the air duct assembly 5 along the axial direction of the purification module 3 and reach the air outlet 12 for outflow. When the air flows through the purification and humidification module, the air may first flow through the purification module 3 for purification. For the air flowing through the purification module 3, and a part of the air may flow through the wet pad 22 for humidification, and then flow into the air duct assembly 5 under guidance of the air guide ring 51, and the other part of the air may flow directly into the air duct assembly 5 under the guidance of the air guide ring 51 without being humidified by the wet pad 22. Finally, the air in the air duct assembly 5 is discharged from the air outlet 12.

In some exemplary embodiments, as shown in FIG. 2, when the humidification module 2 is in the humidifying state, a height by which the end of the purification module 3 close to the blower 4 protrudes from the end of the wet pad 22 close to the blower 4 is H, a minimum inner diameter of the air guide ring 51 is D, and $0.1 \leq H/D \leq 0.4$.

As shown in FIG. 2, the inner wall surface of the air guide ring 51 is a cambered surface, and the inner diameter of the air guide ring 51 gradually decreases along the flow direction of the airflow, and the inner diameter of the air guide ring 51 is the smallest at an air outlet side of the air guide ring 51, which is D. When the humidification module 2 is in the humidifying state, a height by which the end of the purification module 3 close to the blower 4 protrudes from the end of the wet pad 22 close to the blower 4 is H, and the relationship between H and D satisfies $0.1 \leq H/D \leq 0.4$, that is, a value range of H/D is between 0.1 and 0.4, for example, the value of H/D may be 0.15, 0.2, 0.25, 0.3, 0.35, etc.

When the humidification module 2 is in the humidifying state, the height by which the end of the purification module 3 close to the blower 4 protrudes from the end of the wet pad 22 close to the blower 4 is H, and air passing through the protruding height H of the purification module 3 can directly enter the air duct assembly 5 through the air guide ring 51 without flowing through the wet pad 22, which is conducive to reducing the air flow resistance and ensuring a ventilation efficiency of the whole machine, air passing through the portion of the purification module 3 sleeved outside the wet pad 22 can flow through the wet pad 22 and be humidified. Therefore, dimensions of H and D satisfy the aforementioned relationship, and an amount of air not wetted by the wet pad 22 matches an amount of air passing through the air guide ring 51, which is conducive to ensuring the wind resistance and ventilation efficiency of the whole machine, and brings about good humidification and purification effect.

In one embodiment, the value of H/D is not limited to the above range, and may be adjusted according to actual needs.

To sum up, the present application discloses a purifier with humidifying function, i.e., a humidification and purification apparatus, which includes a machine body with an air inlet and an air outlet, and a wet pad water tank, a purification module, a wet pad, an elevation mechanism, a motor and a centrifugal wind wheel which are disposed in the machine body. In the normal operating state, the motor drives the centrifugal wind wheel to rotate, and external dry air enters from the air inlet and is discharged from the air outlet. A purification module and a wet pad are disposed between the air inlet and the centrifugal wind wheel, and dry air will be first purified by the purification module and wetted by the wet pad before entering the centrifugal wind wheel, and then accelerated by the centrifugal wind wheel and discharged through the air outlet. In the air-drying state, the elevation mechanism operates to drive the elevation bracket to be lifted in the vertical direction. At this time, the wet pad mounted on the elevation bracket is lifted together until it is higher than the water level in the wet pad water tank, and then the motor operates to drive the centrifugal wind wheel to rotate, to air-dry the wet pad.

The blower close to the air outlet (backward centrifugal blower) is used as the power system, and the water tank, filter screen, wet pad, power system and air outlet in the whole machine are disposed along the axial direction, which greatly saves space. At the same time, the purification module and the wet pad are nested, which reduces the air resistance of the whole machine, improves the purification and humidification efficiencies and reduces the noise. At the same time, in the air-drying mode, according to a current water level state detected by the water level detection device, the wet pad is lifted above the actual water level by the elevation mechanism and the motor is started for air-drying, thus avoiding problems of peculiar smell and bacteria breeding caused by long-term immersion in water.

In the description of the present application, it is to be understood that orientation or positional relationships indicated by terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", and the like are based on those shown in the drawings and are intended only for ease of description and simplification of the present application, and are not intended to indicate or imply that the device or element referred must have a particular orientation, be constructed and operated in a particular orientation and therefore cannot be construed as limitations on the present application.

Furthermore, the terms "first", "second", and the like are used for descriptive purposes only and cannot be understood as indicating or implying relative importance or implying the number of features indicated. Thus, features defined with "first", "second" may explicitly or implicitly include at least one of the features. In the description of the present application, unless expressly specified otherwise, "a plurality of/multiple" means at least two, e.g. two, three, etc.

In the present application, unless otherwise expressly specified and limited, terms "mounted", "connected", "connection", "fixed" and the like are understood in a broad sense and may be, for example, a fixed connection, a detachable connection, or an integrated structure. The connection may be mechanical connection or electrical connection, may be direct connection or indirect connection through an intermediate medium, or may be an internal connection between two elements or an interactive relationship between two elements, unless otherwise expressly defined.

In the present application, the first feature being "above" or "below" the second feature may be a direct contact between the first feature and the second feature, or an indirect contact between the first feature and the second feature via an intermediate medium, unless otherwise expressly specified and defined. Moreover, the first feature being "above", "on" and "over" the second feature may be the first feature being directly above or obliquely above the second feature, or simply indicate that a horizontal height of the first feature is greater than that of the second feature. The first feature being "below", "under" and "underneath" the second feature may be that the first feature is directly below or obliquely below the second feature, or simply mean that the horizontal height of the first feature is less than that of the second feature.

In the description of this specification, descriptions with reference to terms "one embodiment," "some embodiments," "example," "specific example," or "some examples," and the like mean that specific features, structures, materials, or characteristics described in connection with the embodiment or example are included in at least one embodiment or example of the present application. In this specification, schematic description of the above terms needs not be directed to the same embodiments or examples. Further, the specific features, structures, materials or characteristics described may be combined in a suitable manner in any one or more embodiments or examples.

Although the embodiments of the present application have been shown and described above, it should be understood that the above-described embodiments are exemplary and cannot be construed as limitations on the present application, and changes, modifications, substitutions and variants may be made to the above-described embodiments.

What is claimed is:

1. A humidification and purification apparatus, comprising:

a machine body, provided with an air inlet and an air outlet;

a purification and humidification module, disposed in the machine body and close to the air inlet; and a blower, disposed in the machine body and close to the air outlet;

wherein the purification and humidification module comprises:

a humidification module, comprising a wet pad water tank, a wet pad and an elevation mechanism, wherein the elevation mechanism is connected to the wet pad and is configured to be capable of driving the wet pad to move, wherein the humidification module is capable of being switched between a humidifying state and a non-humidifying state, and in the humidifying state, a portion of the wet pad is located below a water level of the wet pad water tank to be immersed into water in the wet pad water tank, and in the non-humidifying state, the wet pad is lifted above the water level of the wet pad water tank; and a purification module, having an annular shape and at least partially sleeved outside a portion of the wet pad extending out of the wet pad water tank;

wherein, when the humidification module is in the humidifying state, an end of the purification module close to the blower protrudes from an end of the wet pad close to the blower.

2. The humidification and purification apparatus according to claim 1, wherein the elevation mechanism comprises:

a driving component; and a transmission assembly, connected to the driving component and the wet pad and configured to be capable of converting a rotational movement output by the driving component into a linear movement of the wet pad.

3. The humidification and purification apparatus according to claim 2, wherein the transmission assembly comprises:

a turntable, connected to the driving component, wherein an outer wall surface of the turntable is provided with an external thread; and an elevation bracket, provided with an internal thread matched with the external thread, wherein a guide structure for translating the elevation bracket along an axial direction of the turntable is disposed between the elevation bracket and the wet pad water tank, and the wet pad is mounted to the elevation bracket.

4. The humidification and purification apparatus according to claim 3, wherein the wet pad water tank is provided with a mounting cavity and a reservoir cavity surrounding the mounting cavity, the driving component is mounted in the mounting cavity, the turntable is positioned outside the mounting cavity and rotatably mounted to a cavity wall of the mounting cavity, and a drive shaft of the driving component passes through the cavity wall of the mounting cavity and is connected to the turntable; and the elevation bracket has an annular shape and is sleeved outside the mounting cavity, and the internal thread is disposed on an inner wall surface of the elevation bracket.

5. The humidification and purification apparatus according to claim 4, wherein the purification and humidification module further comprises:

a limit ring, nested between the wet pad and the purification module, and supported on the wet pad water tank, wherein the limit ring is provided with a ventilation hole.

6. The humidification and purification apparatus according to claim 3, wherein the wet pad has an annular shape and is sleeved outside the elevation bracket; and an outer wall surface of the elevation bracket is provided with a step surface supporting the wet pad.

7. The humidification and purification apparatus according to claim 6, wherein the purification and humidification module further comprises:

a limit ring, nested between the wet pad and the purification module, and supported on the wet pad water tank, wherein the limit ring is provided with a ventilation hole.

8. The humidification and purification apparatus according to claim 3, wherein the purification and humidification module further comprises:

a limit ring, nested between the wet pad and the purification module, and supported on the wet pad water tank, wherein the limit ring is provided with a ventilation hole.

9. The humidification and purification apparatus according to claim 2, wherein the purification and humidification module further comprises:

a limit ring, nested between the wet pad and the purification module, and supported on the wet pad water tank, wherein the limit ring is provided with a ventilation hole.

10. The humidification and purification apparatus according to claim 1, wherein a movement direction of the wet pad is configured to be parallel to an axial direction of the purification module, and a height of the wet pad extending into the purification module is configured to be increased as the wet pad is lifted and to be decreased as the wet pad is lowered.

11. The humidification and purification apparatus according to claim 10, wherein the purification and humidification module further comprises:

a limit ring, nested between the wet pad and the purification module, and supported on the wet pad water tank, wherein the limit ring is provided with a ventilation hole.

12. The humidification and purification apparatus according to claim 1, wherein the purification and humidification module further comprises a water level detection device configured to detect an actual water level of the wet pad water tank;

the humidification and purification apparatus further comprises: a control device electrically connected to the water level detection device and the elevation mechanism; the control device is configured to control operation of the elevation mechanism according to a detection result of the water level detection device, wherein a portion of the wet pad is moved below the actual water level of the wet pad water tank, or the wet pad is lifted above the actual water level of the wet pad water tank.

13. The humidification and purification apparatus according to claim 12, wherein the control device is electrically connected to the blower and is configured to control operation of the blower to air-dry the wet pad after the wet pad is lifted above the water level of the wet pad water tank.

14. The humidification and purification apparatus according to claim 12, wherein the purification and humidification module further comprises:

a limit ring, nested between the wet pad and the purification module, and supported on the wet pad water tank, wherein the limit ring is provided with a ventilation hole.

15. The humidification and purification apparatus according to claim 1, further comprising:

a control device, electrically connected to the elevation mechanism, and configured to control operation of the elevation mechanism, wherein a portion of the wet pad is moved below a rated water level of the wet pad water tank, or the wet pad is lifted above the rated water level of the wet pad water tank.

16. The humidification and purification apparatus according to claim 15, wherein the purification and humidification module further comprises:

a limit ring, nested between the wet pad and the purification module, and supported on the wet pad water tank, wherein the limit ring is provided with a ventilation hole.

17. The humidification and purification apparatus according to claim 1, wherein the purification and humidification module further comprises:

a limit ring, nested between the wet pad and the purification module, and supported on the wet pad water tank, wherein the limit ring is provided with a ventilation hole.

18. The humidification and purification apparatus according to claim 1, further comprising:

an air duct assembly, disposed in the machine body and communicated with the air inlet and the air outlet, wherein the blower is disposed in the air duct assembly, the purification and humidification module is disposed between an air inlet side of the air duct assembly and the air inlet, and the purification and humidification module and the air duct assembly are disposed along an axial direction of the purification module; and wherein the blower is configured to drive air to enter from the air inlet, flow through the purification and humidification module along a radial direction of the purification module, then flow through the air duct assembly along the axial direction of the purification module and reach the air outlet for outflow.

19. The humidification and purification apparatus according to claim 18, wherein when the humidification module is in the humidifying state, a height by which the end of the purification module close to the blower protrudes from the end of the wet pad close to the blower is H, and an air guide ring is provided at the air inlet side of the air duct assembly, a minimum inner diameter of the air guide ring is D, and $0.1 \leq H/D \leq 0.4$.

* * * * *